US006168267B1

(12) United States Patent
Komplin

(10) Patent No.: US 6,168,267 B1
(45) Date of Patent: Jan. 2, 2001

(54) PRESSURE CONTROLLED INK CARTRIDGE

(75) Inventor: Steven Robert Komplin, Lexington, KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/512,420

(22) Filed: Feb. 23, 2000

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 4,712,172 * 12/1987 Kiyohara et al. ..... 347/87 X
5,347,299 * 9/1994 Entz et al. ..... 347/232
5,574,489 * 11/1996 Cowger et al. ..... 347/86
5,856,838 1/1999 Oda et al. .
5,886,721 3/1999 Fujii et al. .
5,923,353 7/1999 Boyd et al. .
5,933,175 8/1999 Stathem et al. .
5,967,045 10/1999 Staiger et al. .
6,003,984 * 12/1999 Bohorquez et al. ..... 347/86

FOREIGN PATENT DOCUMENTS 58-53473 * 3/1983 (JP) ..... 347/86
94/11195 * 5/1994 (WO) ..... 347/86

* cited by examiner

*Primary Examiner*—David F. Yockey
(74) *Attorney, Agent, or Firm*—Michael T. Sanderson; Luedeka, Neely & Graham

(57) ABSTRACT

An ink cartridge for an ink jet printer which includes a body portion having a substantially continuous side wall perimeter extending from a substantially planar first side panel portion. A cavity for containing ink is defined by a second side panel portion, the side wall perimeter and the first side panel portion. A lung type pressure regulator is disposed within the cavity and has at least one lung frame wall disposed at an angle within the cavity with respect to a cavity side wall for promoting gas formation in the cavity.

11 Claims, 5 Drawing Sheets

PRESSURE CONTROLLED INK CARTRIDGE

FIELD OF THE INVENTION

The invention relates to an improved ink cartridge and to a pressure control system for maintaining ink cartridge pressure.

BACKGROUND

Ink jet technology continues to be improved in order to increase printing speed and print quality or resolution. One means for improving print speed and quality is to increase the number of nozzle holes in an ink jet printhead and to decrease the diameter of the nozzle holes. However, improvements in print speed and quality often result in operational problems not experienced with lower quality slower speed printers.

In an ink jet printer, ink is provided to the printhead from an ink cartridge or supply tank. The ink flows from the tank through a connecting conduit from the ink cartridge through an ink via in a semiconductor chip or around the edges of a semiconductor chip and into ink flow channels and an ink chamber. The ink chamber is situated in axial alignment with a corresponding nozzle hole and a heater resistor defined on the surface of the semiconductor chip. As electrical impulse energy is applied to the heater resistor, the ink adjacent the resistor is heated and a bubble of ink forms which is ejected from the nozzle hole onto a print medium. By selective activation of a plurality of heater resistors on a printhead, a pattern of ink dots are applied to the print medium to form an image.

A critical aspect of the printing process is the controlled supply of ink to the printhead. If the pressure in the ink supply cartridge is too high, ink may run out freely from the printhead onto the print medium before the heater resistor is activated. If the pressure in the ink supply cartridge is too low, the ink channels and chambers on the printhead will not refill fast enough. If the ink chambers and channels are not refilled fast enough there will be missing ink dots or the print speed must be lowered to allow time for ink to refill the ink chambers. Furthermore, as ink is used from the ink cartridge, the pressure in the ink cartridge may decrease to a point which inhibits flow of the remaining ink in the cartridge to the printhead. Accordingly, as the number of nozzles holes on a printhead increases and the diameter of the holes decreases, maintaining a predetermined ink supply pressure in the ink supply system becomes more critical.

There are two primary methods for maintaining ink supply flow to printheads. The first method includes the use of a porous capillary member such as foam which is saturated with ink and provides a controlled flow of ink to the printheads. The second method includes the use of a diaphragm or bellows to provide pressure or back pressure on the ink in the cartridge. Use of a diaphragm or bellows enables the cartridge to be filled with liquid ink as opposed to the use of foam saturated with ink. Accordingly, the ink cartridge may be made smaller for the same volume of ink delivered to the printheads. One disadvantage of smaller ink cartridges which use a diaphragm or bellows for pressure control is that maintaining tolerances during the manufacture of the cartridge body becomes more difficult.

There is a need therefor for an improved pressure controlled ink supply system which maintains a predetermined pressure in an ink supply cartridge so that sufficient ink is provided to a printhead throughout the life of the ink supply cartridge.

SUMMARY OF THE INVENTION

With regard to the above and other objects and advantages, the invention provides an ink cartridge for an ink jet printer, the cartridge including a body portion having a substantially continuous side wall perimeter extending from a substantially planar first side panel portion. A cavity for containing ink is defined by a second side panel portion, the side wall perimeter and the first side panel portion. A lung type pressure regulator is disposed within the cavity and has at least one lung frame wall disposed at an angle within the cavity with respect to a cavity side wall for promoting gas formation in the cavity.

In another aspect the invention provides a method for making an ink supply cartridge for an ink jet printer. The method includes injection molding a substantially rectangular body from a thermoplastic material, the body containing side walls and a first side panel defining an open-ended chamber. A bubble generator and an ink feed port are injection molded integral with a first side wall of the rectangular body, the bubble generator and ink feed port being in fluid flow communication with the chamber. A lung type pressure regulator is also injection molded integral with the body so that the pressure regular is disposed within the chamber of the rectangular body and has at least one lung frame wall adjacent the bubble generator disposed at an angle with respect to the first side wall for promoting gas bubble formation in the chamber. A second side panel is also injection molded from the thermoplastic material, and is fixedly attached the second side panel to the rectangular body to define a closed chamber for containing ink.

In yet another aspect the invention provides an ink jet printer cartridge including a substantially rectangular body having side walls and first and second side panels attached to the side walls defining an ink cavity. Ink is disposed in the ink cavity. A bubble generator is disposed in at least one of the side walls of the rectangular body, and a pressure regulator is disposed in the ink cavity for regulating ink pressure within the cavity. The pressure regulator includes at least one frame wall disposed at an angle with respect to the side wall of the rectangular body containing the bubble generator for promoting gas bubble formation in the ink.

An important feature of the invention is a pressure regulator such as a lung having a lung frame disposed in the body cavity of an ink cartridge wherein the frame of the lung has a surface which promotes gas bubble formation in the cavity. For example, a lung having a lung frame disposed at an angle relative to the body cavity has a number of advantages. One advantage of an angled lung is that the side walls defining the frame of the lung promote gas bubble formation and flow so that the bubbles do not remain closely adjacent to the bubble generator aperture but travel into the main ink cavity. Another advantage is that warpage of the side walls of the body of the ink cartridge may be minimized or reduced because only a small portion of the hot tooling for the lung frame is adjacent the cartridge side walls during molding. Another advantage is that there is increased space within the ink chamber for inserting a ball check valve for the ink feed port. The ink chamber also contains sufficient space for an ink level sensor. Still another advantage is that any ink which may find its way into the lung chamber is urged to drain more readily from the chamber along the angled frame walls.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE PREFERRED EMBODIMENTS

Figure 1:
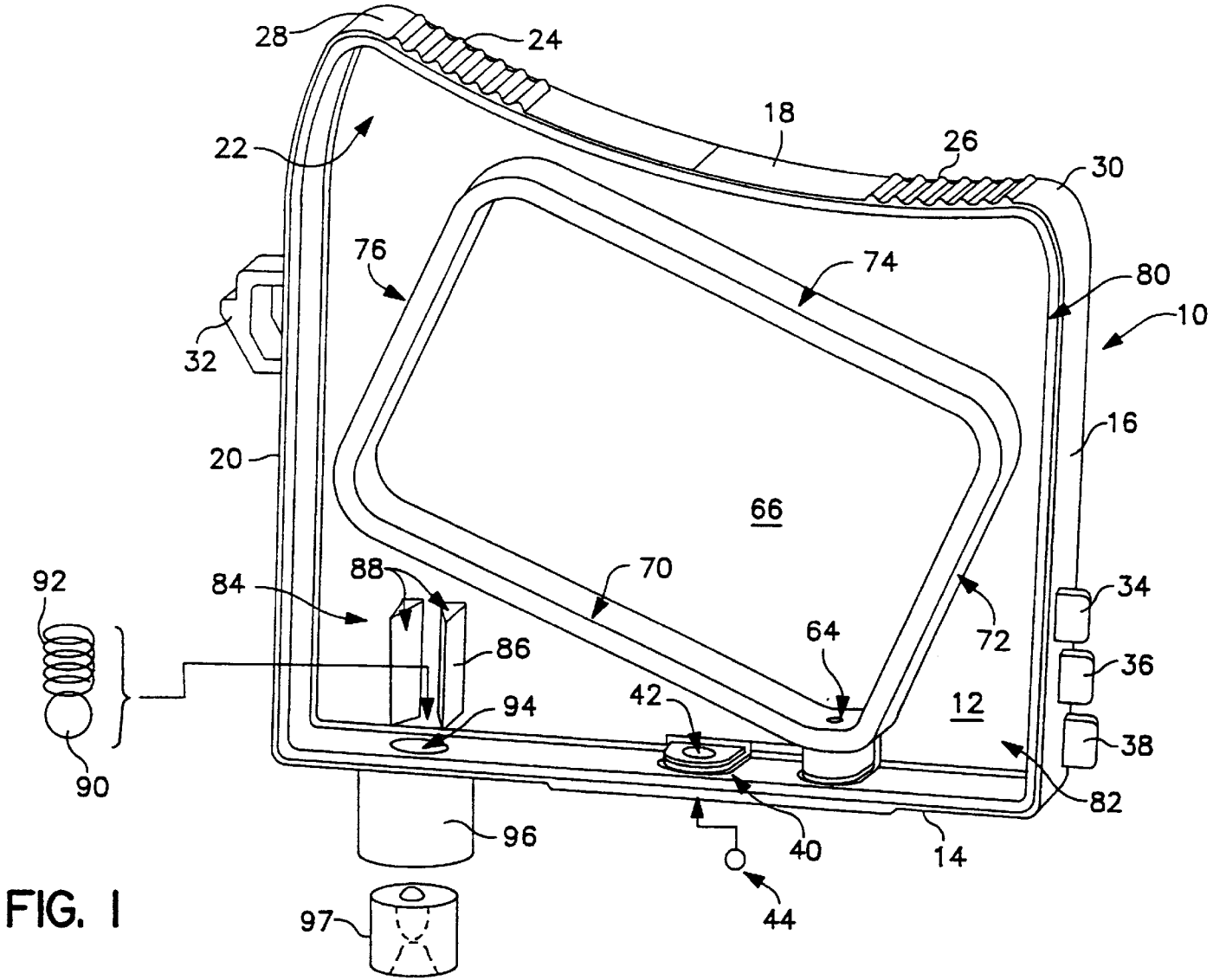
FIG. 1 is an inside perspective view of an ink cartridge body according to invention.
Figure 2:
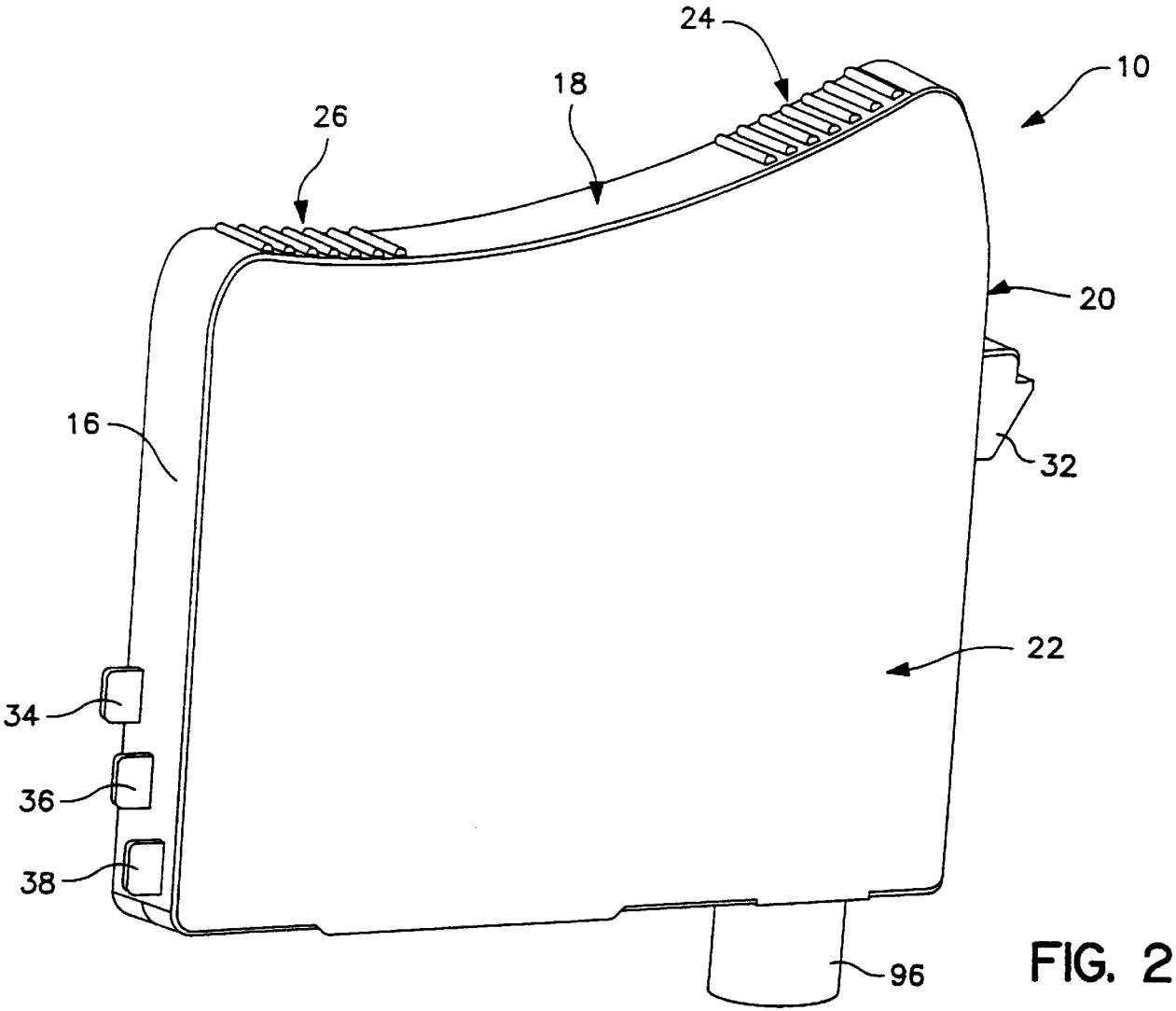
FIG. 2 is an outside perspective view of an ink cartridge body according to the invention.
Figure 3:
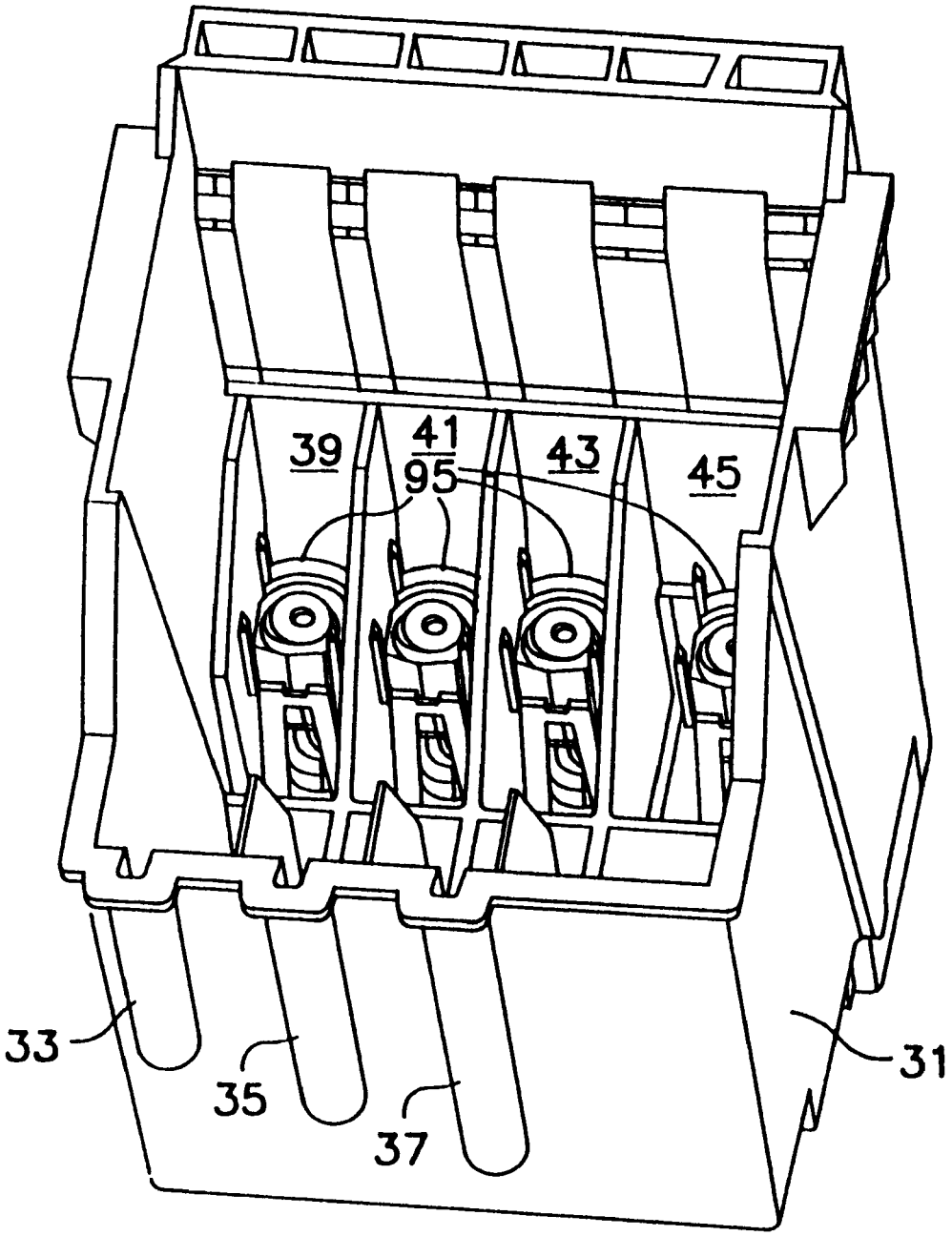
FIG. 3 is a top perspective view of a printhead body for use with an ink cartridge body according to the invention.

With reference to FIGS. 1 and 2 there is provided a substantially rectangular ink cartridge body 10 containing an interior cavity 12 for containing ink. The body 10 has first, second, third and fourth side walls 14, 16, 18 and 20 defining the perimeter of cavity 12. The side walls 14–20 are each attached to a first side panel portion 22. Side wall 18 may contain a handle or preferably contains ridges 24 and 26 which are disposed toward opposite ends 28 and 30 of side wall 18 for use in inserting and removing ink cartridge body 10 from a printhead body 31 (FIG. 3). Side wall 18 is preferably arc-shaped so that side wall 20 has a length greater than side wall 16. Side wall 20 also preferably contains a latch 32 for attaching the ink cartridge body 10 to a printhead body 31 of an ink jet printer.

Side wall 16 of the cartridge body 10 preferably contains a plurality of staggered tabs such as tabs 34, 36 and 38 which may be removed to provide identification of the ink cartridge with respect to its proper location in a printhead body 31. The tabs 34, 36 or 38 may be removed as by cutting or breaking the tabs from side wall 16 to define an ink cartridge containing tab 34, tab 36 or tab 38 which is made to correspond to keying channels 33, 35 or 37 of cartridge slots 39, 41 or 43 of the printhead body 31 (FIG. 3). A wider cartridge body similar to cartridge body 10, preferably containing no removable tabs, is insertable in cartridge slot 45 of the printhead body 31.

Referring again to FIG. 1, a bubble generator 40 which includes an aperture 42 and a ball 44 is disposed in the first side wall 14 of the rectangular cartridge body 10. The aperture 42 of the bubble generator 40 is in fluid flow communication with the interior cavity 12 of the body 10. Aperture 42 provides an orifice for the bubble generator 40.

After the cavity 12 is filled with ink, a reduced pressure or back pressure is applied to the cavity 12, preferably through an ink feed port 94, described below, to provide a predetermined pressure differential between cavity 12 and an inkjet printhead. As ink is ejected by a printhead, the volume of ink in cavity 12 decreases. A pressure regulator 98, preferably a lung, which is described in more detail below with reference to FIGS. 5 and 6 maintains a predetermined pressure in cavity 12 as the volume of ink in the cavity decreases. The pressure regulator 98 also helps to compensate for pressure changes in ink cavity 12 due to temperature, ambient pressure in the printer or cartridge environment and the like.

In order to maintain the pressure in the ink cavity 12 above a predetermined minimum pressure, the bubble generator 40 is selected to induce gas flow into cavity 12 while preventing flow of ink out of cavity 12. The gas flow bubbles entering the cavity 12 flow through the ink and accumulate in an upper portion of cavity 12 above the ink level. In this way, the pressure in cavity 12 is maintained above a predetermined minimum pressure. In most applications, the predetermined minimum pressure or back pressure ranges from about −12 to about −24 centimeters (cm) of water.

The ball 44 inserted in aperture 42 has a diameter ranging from about 1 to about 5 millimeters, preferably about 3 millimeters and is preferably made of a corrosion resistant material compatible with the ink in the ink cartridge body 10. Such corrosion resistant materials include but are not limited to glass, ceramic, stainless steel, fluorocarbon polymers and the like. The most preferred material is stainless steel.

A significant aspect of the invention relates to the provision of a pressure regulator such as a lung having a lung chamber 66 defined by lung frame walls 70, 72, 74 and 76 and a portion of first side panel 22 lying within the area defined by lung frame walls 70, 72, 74 and 76. At least one of the lung frame walls preferably has a surface, such as the surface of lung frame wall 70 adjacent the bubble generator 40 which promotes gas bubble formation in the interior cavity 12 (FIG. 1). Lung frame wall 70 is preferably angled with respect to an axis parallel with cartridge side wall 14 thereby providing increasingly greater spacing between lung frame wall 70 and cartridge side wall 14 proceeding from cartridge side wall 16 to cartridge side wall 20.

A number of advantages are provided by use of a lung structure possessing angled lung frame wall 70. One advantage is that because frame wall 70 is not closely adjacent aperture 42, there is less inhibition of bubble formation as gas flows into cavity 12 through aperture 42 of bubble generator 40. Less inhibition of bubble formation results in a greater range of pressure control in cavity 12.

Figure 4:
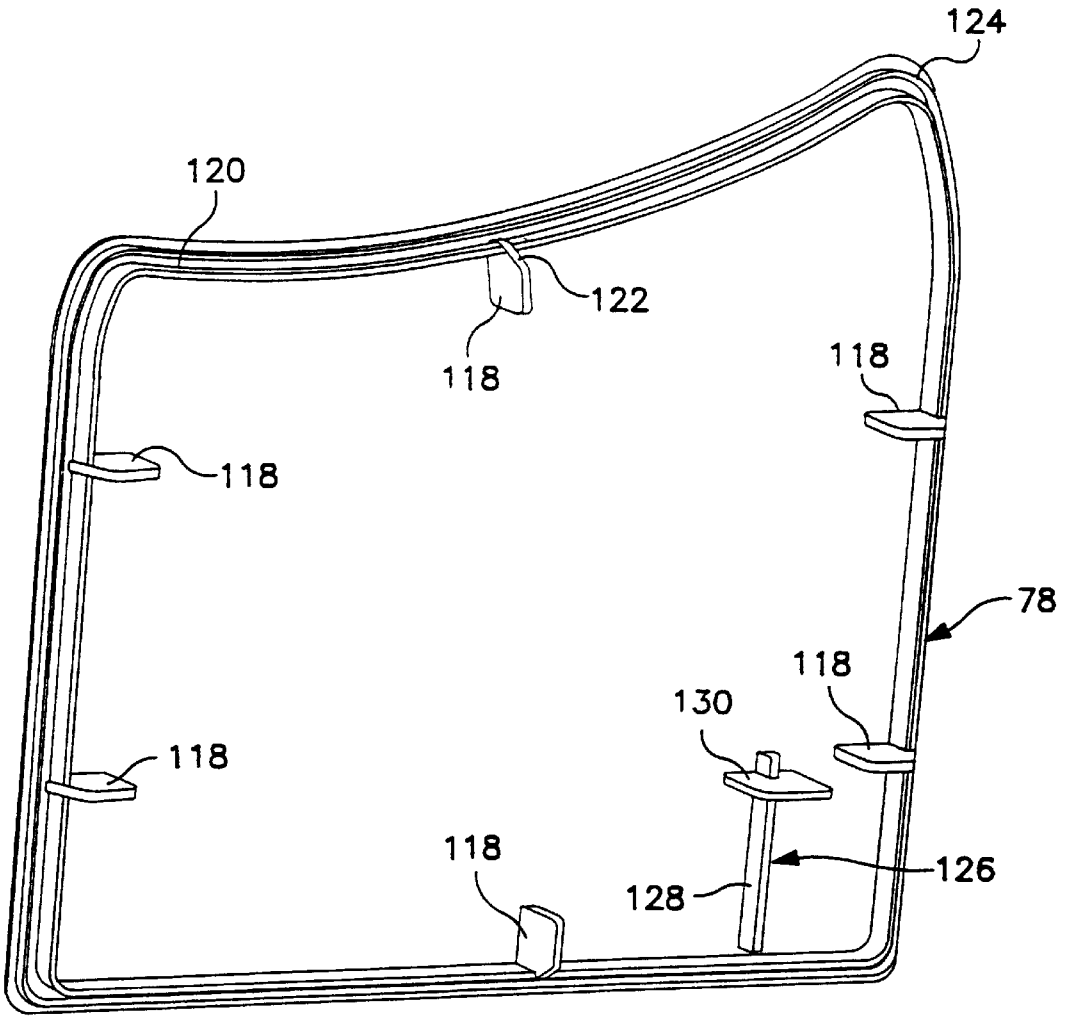
FIG. 4 is an inside perspective view of a second side panel for an ink cartridge according to the invention.

Another advantage is that there is more room between lung frame walls 70, 72, 74 and 76 and cartridge side walls 14, 16, 18 and 20 for tooling used to form cartridge side walls 14, 16, 18 and 20 and lung frame walls 70, 72, 74 and 76. The increased tooling room provides an increased cooling rate of the cavity side of side walls 14, 16, 18 and 20 which in turn reduces the warpage of cartridge side walls 14, 16, 18 and 20 caused by unequal cooling through the thickness of the wall material. Reducing the warpage of side walls 14, 16, 18 and 20 increases the ability to form gas and liquid tight seals between second side panel 78 (FIG. 4) and the welding ledge 80 around the periphery of the cartridge body 10 defined by the edges of cartridge side walls 14, 16, 18 and 20.

The sloping configuration of lung frame wall 70 also functions to direct ink or other liquids which may have flowed into lung chamber 66 toward aperture 64 thereby improving the drainage rate of liquids or ink from chamber 66. It is thus preferred to locate aperture 64 in an apexial area of chamber 66 defined by the intersection of frame walls 70 and 72 as shown in FIG. 1.

Another advantage of the sloped or angled orientation of lung frame wall 70 is the provision of areas 84 and 82 between cartridge side walls 14 and 16 and lung frame walls 70 and 72 respectively. Area 84 preferably has dimensions sufficient to provide for a ball check valve support structure 86 for a ball check valve device. Support structure 86 preferably includes rounded edges 88 and is adapted to guide a ball valve 90 and an urging device for ball valve 90 such as spring 92 in a linear direction through aperture 94 toward and away from boss 96 containing an elastomeric septum 97 upon removal and insertion of an ink supply needle of a needle valve assembly 95 (FIG. 3) through boss 96, septum 97 and associated aperture 94. Septum 97 used for sealing boss 96 includes a septum made from a variety of natural and synthetic rubber materials. During use, an ink supply needle contacts ball valve 90 causing ball valve 90 to recede from septum 97 thereby enabling ink to flow from cavity 12 through the needle to a corresponding printhead on the printhead body 31 (FIG. 3). Upon removal of a needle from boss 96, ball valve 90 is urged by spring 92 toward septum 97 so that ball valve 90 again seals against the septum 97 to prevent flow of ink therethrough when the cartridge body 10 is not attached to a printhead body 31.

The ball valve 90 and spring 92 are preferably constructed of ink resistant materials. Such materials include but are not limited to glass, ceramic, fluorocarbon polymers and metals. A particularly preferred material for ball valve 90 and spring 92 is stainless steel.

Returning to FIG. 1, area 82 in cavity 12 provides a suitable location for a level sensor for detecting the amount of ink remaining in ink cavity 12. If lung frame wall 72 were substantially parallel to cartridge side wall 16, the distance between frame wall 72 and cartridge side wall 16 would not be sufficient for many of the ink level sensing devices commonly used with ink cartridges such as magnetic level sensors, photo-reflective level sensors, ultrasonic level sensors, float-type level sensors and the like.

While the above advantages of an angled lung frame wall 70 have been described generally with respect to substantially rectangular lung chamber 66, similar results may be obtained with lung frame walls which is substantially circular, oval, triangular or other polygonal shape providing there is increasingly greater spacing between frame wall 70 and cartridge side wall 14 when moving from cartridge side wall 16 to cartridge side wall 20.

Figure 5:
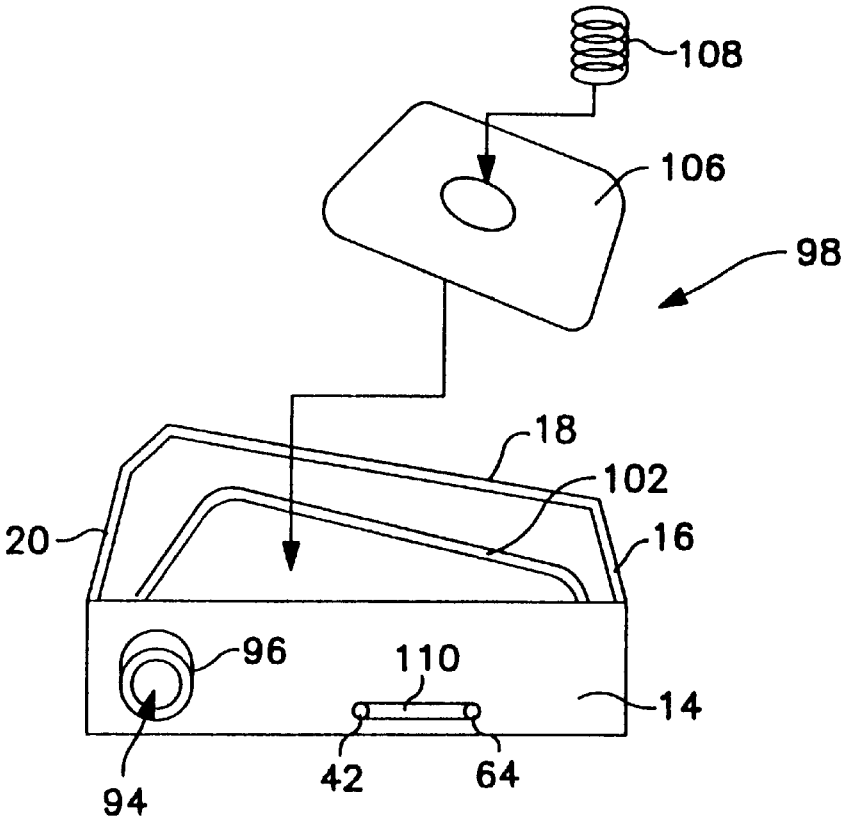
FIG. 5 is a perspective view of a lung for an ink cartridge according to the invention.
Figure 6:
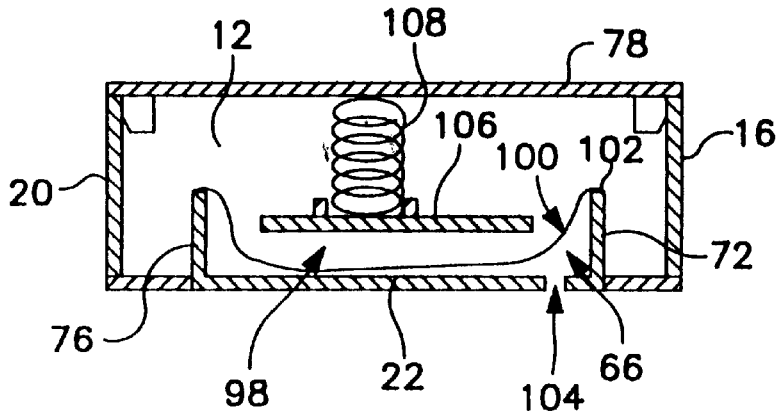
FIG. 6 is a cross-sectional view of a lung for an ink cartridge according to the invention.

Features of lung type pressure regulator 98 will now be described with reference to FIGS. 5 and 6. The lung 98 includes lung chamber 66 defined by lung frame walls 70, 72, 74 and 76 (FIG. 1) and a portion of first side panel 22 lying with the area defined by frame walls 70, 72, 74 and 76. A resilient flexible polymeric material 100 is attached to the peripheral edge 102 defined by frame walls 70, 72, 74 and 76. The flexible polymeric material 100 may be selected from films that are compatible with the material used for forming the ink cartridge body 10 and inks used in the ink cartridge and films adaptable to welding or adhesive attachment thereof to the lung frame walls 70, 72, 74 and 76. A particularly preferred flexible polymeric material 100 a copolymer polypropylene material available from Triangle Plastics of Raleigh, N.C. under the trade name CPP40. The copolymer polypropylene material is preferably laminated with an adhesive available from Minnesota Mining and Manufacturing Company of Minneapolis, Minn. under the trade name 3M-845.

After heat staking the polymeric material 100 to frame walls 70, 72, 74 and 76, the material 100 is heated while applying a reduced pressure to lung chamber 66 by means of vent holes 64 or 104 thereby causing material 100 to closely conform to lung chamber 66. Heating the material 100 while applying reduced pressure to lung chamber 66 has been found to reduce wrinkles and improve the pressure response of pressure regulator 98. Prior to filling cavity 12 with ink, a piston member 106 and urging member 108 are inserted in cavity 12 within the perimeter of frame walls 70, 72, 74 and 76 for urging polymeric material 100 toward first side panel portion 22. A second side panel 78 is then attached to the first, second, third and fourth side walls 14, 16, 18 and 20 of the cartridge body 10. A ball 44 is inserted in the aperture 42 of the bubble generator 40 (FIG. 1) and an adhesive film is applied over aperture 42 and aperture 64 to seal the apertures and channel 110 connecting apertures 42 and 64. The cavity 12 is then filled with ink and a reduced pressure is applied to cavity 12.

Despite the use of an angled pressure regulator 98 in cavity 12, side walls 14, 16, 18 and 20 (FIG. 1) may still be slightly warped or bowed as a result of the injection molding process used to form cartridge 10. In order to counteract the tendency for side walls 14, 16, 18 and 20 to bow or warp, second side panel 78 is adapted to contain urging members 118 (FIG. 4) which are preferably disposed in predetermined locations on second side panel 78. Urging members 118 are preferably upstanding, substantially rectangular tabs containing a chamfered edge such as edge 122 which assists in urging side walls 14, 16, 18 and 20 outwardly so to maintain the planarity of side walls 14, 16, 18 and 20 to reduce the inward bowing of the side walls for sealably welding weld projection 124 to the welding ledge 80 of cartridge body 10 (FIG. 1). Five urging members 118 are shown on side panel 78, however, side panel 78 may contain more or fewer urging members 118 as the need arises and depending on the length of side walls 14, 16, 18 and 20 of body 10.

Another feature of second side panel 78 is raised wall 120 which is disposed inward of weld projection 124 and provides protection for the weld projection 124 against damage during handling of the second side panel 78. Protection of weld projection 124 is desirable because the weld projection 124 is relatively flimsy and may be easily damaged if bumped or otherwise struck with a foreign object. The weld projection 124 provides a site for ultrasonically welding second panel 78 to the welding ledge 80 of body 10. In the alternative, an adhesive may be applied to ledge 80 or to the second side panel 78 in the absence of weld projection 124 to adhesively attach the side panel 78 to the cartridge body 10. Welding or adhesives are required to provide a liquid and gas tight seal between body 10 and panel 78 so as to avoid ink leakage, evaporation of liquid ink components and/or undesired pressure changes within cavity 12.

Another aspect of side panel 78 is guiding member 126 which includes a guide bar 128 and a stop member 130. Guide bar 128 is positioned to be spaced between the two portions of support structure 86 (FIG. 1) so as to retain ball valve 90 and spring 92 between guide bar 128 and rounded edges 88 of support structure 86. Stop member 130 provides a retainer for spring 92 so that spring 92 can exert urging resistance on ball valve 90 thereby sealing orifice 94 when the cartridge body 10 is not attached to a printhead body 31.

With respect to the cartridge body 10 and second panel 78, all of the features described above, with the exception of the ball 44, ball valve 90, spring 92, flexible polymeric material 100, piston member 106 and urging member 108 are molded into the cartridge body 10 and side panel 78. Accordingly, body 10 and side panel 78 are preferably molded from materials selected from the group of thermoplastic materials including but not limited to polyphenylene oxide/polystyrene alloys, polypropylene, acrylonitrile/butadiene/styrene terpolymers, polystyrene/butadiene alloys or copolymers, polyetherimide, polysulfone, polyesters and the like. A particularly preferred material for body 10 and panel 78 a polypropylene material having a melt flow rate of about 12 grams per 10 minutes according to ASTM D-1238 and a density of about 0.9 grams/cm$^3$ according to ASTM D-1505 available from Huntsman Polypropylene Corporation of Woodbury, N.J. under the trade name P4G4B-036.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. An ink cartridge for an ink jet printer, the cartridge comprising a body portion having a substantially continuous side wall perimeter extending from a substantially planar first side panel portion, a cavity defined by a second side panel portion, the side wall perimeter and the first side panel portion for containing ink and a substantially rectangular lung type pressure regulator disposed within the cavity and attached to the first side panel portion, said lung type pressure regulator having a size sufficient to provide a predetermined back pressure within said cavity, said lung type pressure regulator having at least one lung frame wall for promoting gas formation in the cavity, said lung frame wall being disposed within the cavity in an angular range from about 5 to about 20 degrees with respect to an axis parallel with the first side wall of the body portion.

2. The ink cartridge of claim 1 wherein the pressure regulator is a substantially oval-shaped structure having curved upstanding frame walls attached to the first side panel portion of the body portion and having a size sufficient to provide a predetermined back pressure within said cavity.

3. The ink cartridge of claim 1 further comprising an ink feed port attached to the first side wall of the body portion and a ball check valve and ball urging member for sealing the ink feed port when the cartridge is not attached to an ink jet printer.

4. The ink cartridge of claim 1 further comprising a plurality of removable tabs attached on a second side wall of the body portion whereby the tabs are external to the cavity.

5. The ink cartridge of claim 1 wherein the second side panel portion farther comprises projections pending therefrom inside the cavity for reducing inward flex of the side walls of the body portion.

6. An ink jet printer cartridge comprising a substantially rectangular body having side walls and first and second side panels attached to the side walls defining an ink cavity, ink disposed in the ink cavity, a bubble generator disposed in at least one of the side walls of the rectangular body and a substantially rectangular pressure regulator disposed in the ink cavity for regulating ink pressure within the cavity, the pressure regulator being defined by a portion of the first side panel of the cartridge and upstanding frame walls attached to the first side panel forming an open-ended chamber and having at least one frame wall disposed at an angle with respect to the side wall of the rectangular body containing the bubble generator for promoting gas bubble formation in the ink, said frame wall being disposed in an angular range from about 5 to about 20 degrees with respect to an axis parallel one of said side walls of the substantially rectangular body.

7. The ink jet printer cartridge of claim 6 wherein the pressure regulator further comprises a substantially gas impermeable flexible polymeric member sealingly attached to edges of the upstanding frame walls opposite the first side panel.

8. The ink jet printer cartridge of claim 7 further comprising an urging member disposed adjacent the polymeric member between the polymeric member and the second side panel of the ink jet printer cartridge for urging the polymeric member toward the first side panel.

9. The ink jet printer cartridge of claim 6 further comprising an ink feed port attached to at least one of the side walls of the rectangular body and a ball check valve and ball urging member for sealing the ink feed port when the cartridge is not attached to an ink jet printer.

10. The ink jet printer cartridge of claim 6 further comprising a plurality of removable tabs attached on a side wall of the rectangular body whereby the tabs are external to the ink cavity.

11. The ink jet printer cartridge of claim 6 wherein the second side panel further comprises projections pending therefrom inside the ink cavity for reducing inward flex of the side walls of the rectangular body.

* * * * *